United States Patent [19]

Raffault

[11] Patent Number: 4,667,456

[45] Date of Patent: May 26, 1987

[54] MACHINE FOR PACKING PRODUCTS IN A THERMORETRACTABLE FILM

[76] Inventor: Gérard Raffault, Les Carrières, Lucenay 69480 Anse, France

[21] Appl. No.: 797,617

[22] Filed: Nov. 13, 1985

[30] Foreign Application Priority Data

Nov. 15, 1984 [FR] France ..... 84 17992

[51] Int. Cl.[4] ..... B65B 53/02

[52] U.S. Cl. ..... 53/557; 53/390; 53/442; 53/568

[58] Field of Search ..... 53/373, 390, 557, 568, 53/442

[56] References Cited

U.S. PATENT DOCUMENTS

| | | | |
|---|---|---|---|
| 3,047,991 | 8/1962 | Siegel et al. | 53/568 |
| 3,323,282 | 6/1967 | Duns | 53/568 |
| 3,420,034 | 1/1969 | Saraisky et al. | 53/557 |
| 3,710,550 | 1/1973 | Osborne | 53/557 |
| 3,830,036 | 8/1974 | Harkness et al. | 53/557 |
| 3,910,011 | 10/1975 | Beninger | 53/557 |
| 4,162,604 | 7/1979 | Bartolomei | 53/557 |
| 4,562,689 | 1/1986 | Hannen | 53/557 |

FOREIGN PATENT DOCUMENTS

| | | |
|---|---|---|
| 2278962 | 2/1976 | France . |
| 2342894 | 9/1977 | France . |
| 2397329 | 2/1979 | France . |

*Primary Examiner*—John Sipos
*Assistant Examiner*—Donald R. Studebaker
*Attorney, Agent, or Firm*—Parkhurst & Oliff

[57] ABSTRACT

Machine for packing products in a thermoretractable film is disclosed and includes a roll supplying a supple film center-folded in two layers for wrapping a product, means for separating the two layers of film, means for welding the periphery of said film, and means for retracting the film about the product to be packed. In the machine the welding and retraction means are regrouped into one working station on a fixed table. The retraction means are constituted by a movable structure, disposed in parallel to and above the fixed table, said structure being equipped with a source of hot air directed towards the table, and being able, on the one hand, to slide horizontally along the table so as to sweep the surface of the film to be retracted, after edge-to-edge welding; and on the other hand, to pivot inside an orthogonal plane with respect to the plane of the table.

3 Claims, 4 Drawing Figures

MACHINE FOR PACKING PRODUCTS IN A THERMORETRACTABLE FILM

BACKGROUND AND SUMMARY OF THE INVENTION

The present invention relates to a machine for packing different types of products in a thermoretractable film.

It is well known to pack different types of products such as foodstuffs, printing or stationary articles, or mechanical parts in thermoretractable films welded on their edges.

A machine of this type is essentially composed of:

a roll of film center-folded in two layers means, such as a pin or the like, to separate the two layers of film and to place the product to be packed, therebetween, a welding station where the periphery of the two layers of film is welded edge-to-edge about the product; and a retraction station where the whole assembly is subjected to a heat treatment in order to cause the retraction of the film about the product, thus adopting the shape of said product.

In U.S. Pat. Nos. 4,104,848 and 4,162,604, a machine of the aforesaid type is proposed in which the welding station and the retraction station are regrouped into one station, essentially composed of:

a fixed working table which is perforated and designed to receive the product inside the wrapper to be retracted, a bell part, pivotally mounted on one of the edges of the working table, and of which two adjacent sides, forming L, are equipped with electric welding elements; and heating means, operationally coupled to blower means, placed on the other side of the working table.

According to this rather cumbersome arrangement, the pivotally mounted bell part being in most cases opaque, the product to be packed is then hidden from the operator throughout the whole welding and retraction operation, this preventing the operator from controlling this operation and from intervening if the need arises. Moreover, when the operator raises the hinged bell part, once the operation is completed, the hot air contained therein rises up to his face, which is unpleasant. Finally, whatever the size of the product to be packed, it is necessary at each operation to heat the entire volume inside the bell, which constitutes a great and unnecessary expense.

It is the object of the present invention to overcome these disadvantages by proposing a machine of the aforesaid type for packing goods in a thermoretractable film, or which is of reasonable dimension, and reasonably cheap to build and to run, and in which the product being packed is always visible throughout the critical phase of retraction, thus permitting the intervention of the operator if the need arises during the said phase, and finally a machine which can be used even by inexperienced people.

The improved machine for wrapping goods in a thermoretractable film, according to the invention, which is of the type comprising:

a roll supplying a supple film center-folded in two layers, for wrapping a product, means for separating the two layers of film, means for welding the periphery of said film, means for retracting the film about the product to be packed, and in which machine the welding and retraction means are regrouped into one working station on a fixed table. The retraction means are constituted by a movable structure, disposed in parallel to and above the fixed table, said structure being equipped with a source of hot air directed towards the table and being able on the one hand, to slide horizontally along the table so as to sweep the surface of the product to be retracted, after edge-to-edge welding;

and on the other hand, to pivot inside an orthogonal plane with respect to the plane of the table.

In other words, the invention consists in using in the single working station, as retraction means, no longer a hinged bell part, but instead a heating structure, which is likewise pivotally mounted, but which also enables to sweep the whole surface of the product to be packed.

Advantageously, in practice, the movable structure parallel to the table comprises:

a hollow transverse arm, which is open on its face opposite the table, and which is mounted for pivoting about and along a longitudinal axis parallel to the edge of the table, said hollow arm being joined to a fan blowing air onto heating elements provided inside said hollow arm, and an operating handle placed at the end of the hollow arm opposite that receiving the pivoting pin, permitting the actuating of said arm along and about said pin;

the welding means are composed of a frame, of which two L-forming contiguous sides are equipped with electric heating elements, said frame being tiltable about the longitudinal axis parallel to the table and guiding the end of the tiltable movable structure, whereas the other end of said structure is guided inside a longitudinal slide provided to this effect inside the frame;

the working table is constituted by a metallic grid, adjustable in height with respect to said movable frame;

the movable retraction frame, slidable and tiltable about and along the longitudinal axis parallel to the table, is fast with the welding frame and comprises:

blower means;

two parallel and hollow transverse arms, placed on either sides of the grid table, each arm comprising:

a conduit connecting it with the blower means, an electric heating element, a longitudinal slot situated opposite the working grid and designed to direct the hot air blow onto the films to be retracted, welded around the product to be packed, an operating handle, fixed on the end of the upper arm and designed, after the edge-to-edge welding of the two layers of film, to enable the longitudinal sliding of the movable frame along and about the working table.

BRIEF DESCRIPTION OF THE DRAWINGS

The invention will be more readily understood on reading the following description with reference to the accompanying drawings in which.

DETAILED DESCRIPTION OF THE PREFERRED EMBODIMENT

Figure 1:
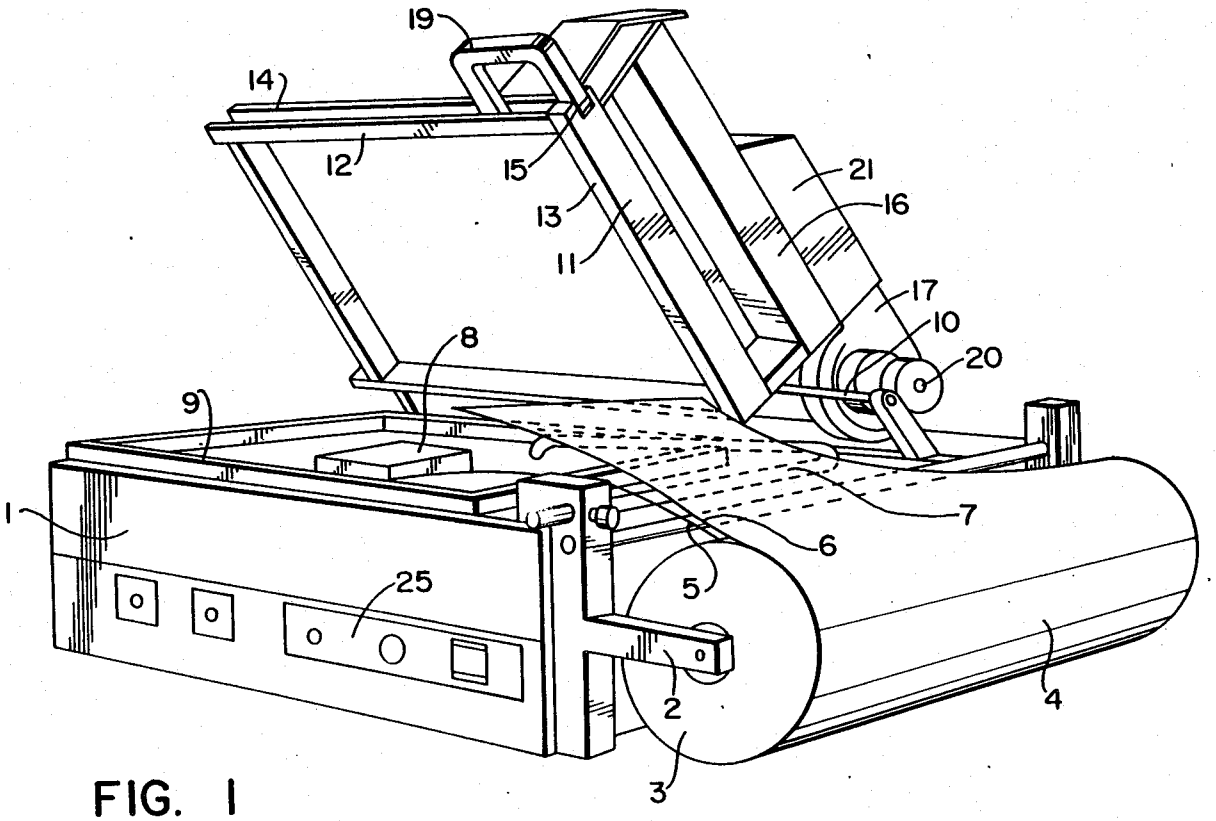
FIGS. 1 and 2 are summary perspectives of a first embodiment of the machine according to the invention, showing two successive stages of operation, respectively open (FIG. 1) for positioning the product to be packed, and closed (FIG. 2) for the welding and retraction operation.

The packing machine according to the invention is essentially constituted by a metal structure (1), supporting a fixed arm (2) at one end for receiving a roll (3) of thermoretractable film (4) U-folded in two layers (5) and (6), in vinyl polychloride for example. When unrolling the film, the two layers (5) and (6) pass respectively underneath and above a transverse separating pin (7) fixed on one side of the frame (1), in order to separate said layers for receiving the product (8) to be packed. The upper part of the structure (1) forms a working table designated by reference number (9). Said working table (9) is equipped with a lateral longitudinal spindle (10) oriented perpendicularly to the direction of transverse pin (7) and parallely to the edge of the table (9). On said longitudinal spindle (10), is pivotally mounted a tiltable frame (11) the inner face of two contiguous sides (12,13) of which is equipped with heating elements, permitting the edge-to-edge welding of the two layers (5) and (6) on each side of the article (8) laid on the table (9).

Said tiltable frame (11) comprises, parallely to spindle (10) and opposite the latter, a guiding rail(14) inside which slides the corresponding lower end (15) of a movable structure (16). The opposite end (17) of said structure (16) slides, via sleeve (18) along spindle (10). Close to slide guide (14), the structure (16) is provided with an operating handle (19).

According to the characteristic features of the invention, the movable structure (16) placed parallely to and above the table (9) is equipped with blowing means (20) connected via conduit (21) to a hollow arm (22) inside which is located an electrical heating element (23). Said transverse hollow arm (22) is open on the face opposite the table (9) thus constituting a ramp capable of blowing hot air downwards as indicated by arrows (24).

On its front part, the structure (1) is also provided with a control panel (25).

To wrap a product, such as for example a book (8), the operator lifts up frame (11) (FIG. 1). He rolls out a length of the two layers (5) and (6) long enough to reach above the working top (9) and places the book between said layers, the whole assembly resting on table (9).

Figure 2:
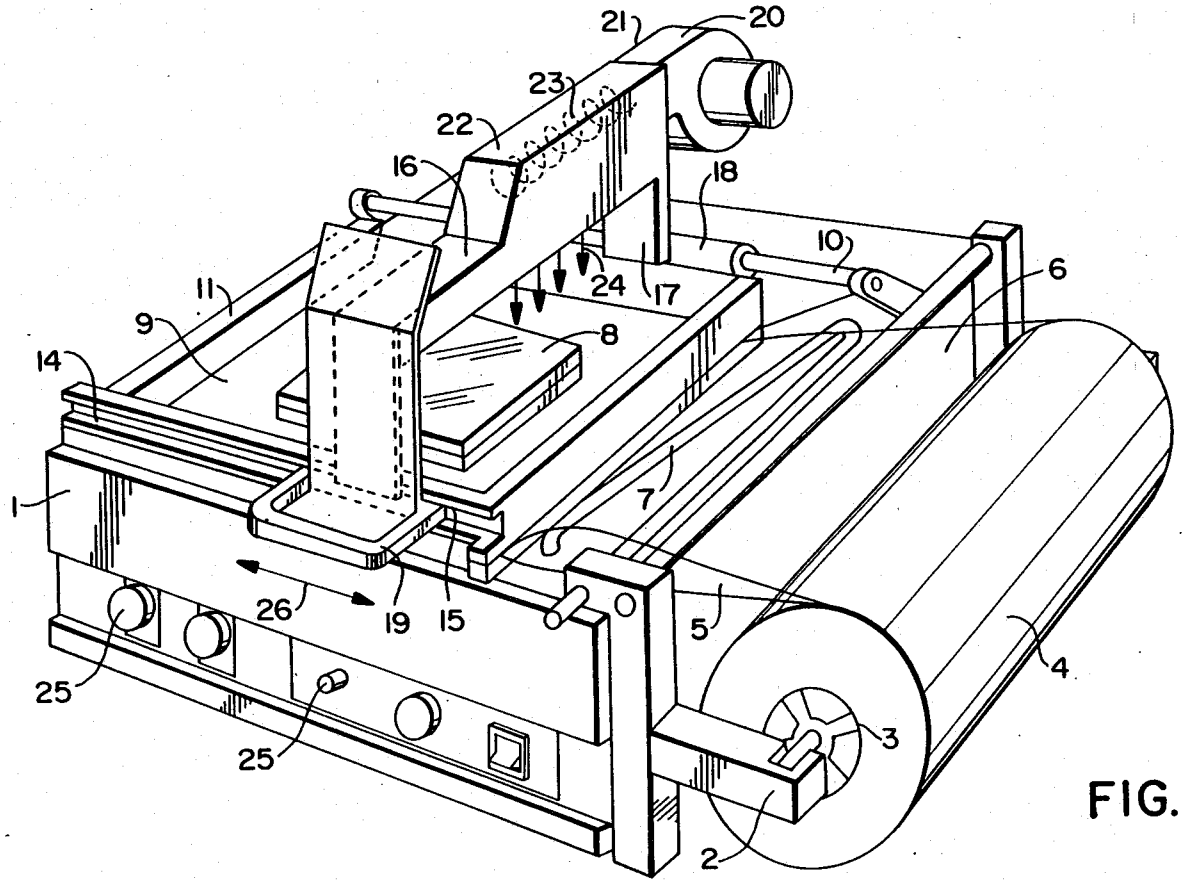

The operator then brings down the frame (11) (FIG. 2). By actuating the knobs on the control panel (25), he actuates the heating elements (12,13) to cause the edge-to-edge welding of the layers (5) and (6) hence the cutting-off. Immediately after, and without having to move the frame (11), the operator actuates the handle (19) to move the structure (16) forward as indicated by the double arrow (26). Thus, the movable structure (16) sweeps the upper part of the table (9) with a hot air blow, as indicated by arrows (24), in the direction of the book (8) to be wrapped. This causes the retraction of the film layers welded about the book (8).

When the operator has raised up the frame (11), he only has to pick up the wrapped book (8).

Figure 3:
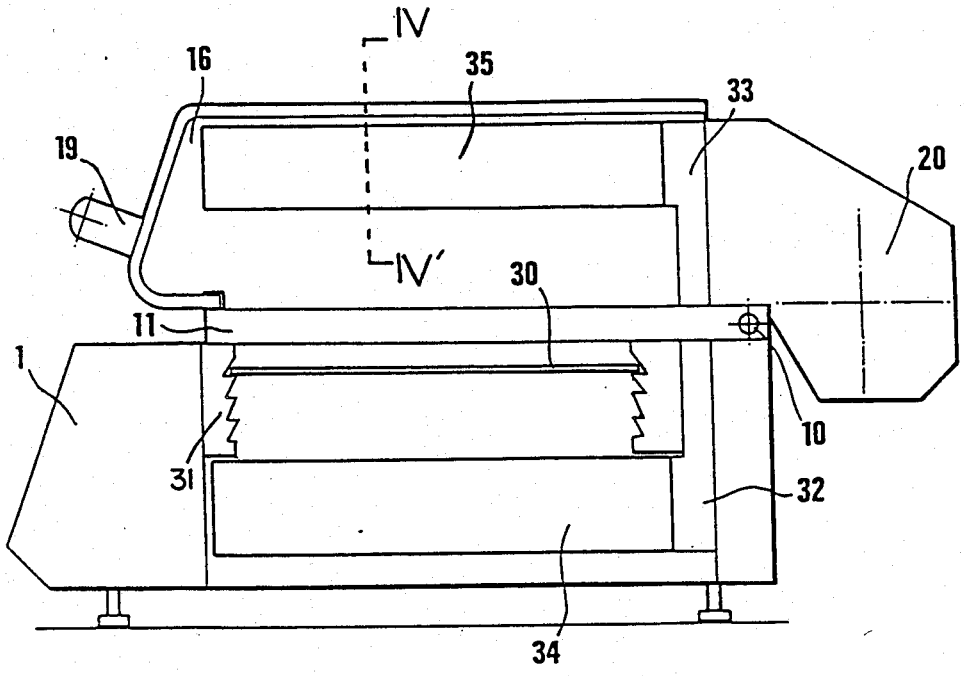
FIG. 3 is a cross-sectional view of another preferred embodiment of the invention.
Figure 4:
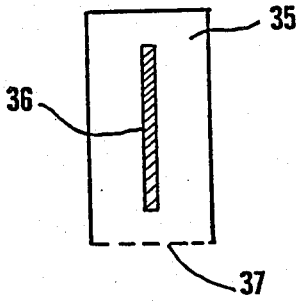
FIG. 4 is a cross-section along line IV—IV'.

According to the preferred embodiment illustrated in FIGS. 3 and 4, the machine essentially comprises a metal grid (30) designed to form the working table and to receive the product (8) to be packed inside the two layers (5) and (6). Said grid (30) is adjustable in height with respect to the movable heating structure, due to notches (31) provided to this effect. As in the preceding embodiment, the movable structure (16) is fast with the welding frame (11). Said movable retraction structure is essentially composed of blower means (20) situated level with the longitudinal spindle (10) parallel to the working table (9) joined by way of two conduits (32,33) to two parallel hollow arms (34,35) placed on each side of the grid (30). Each of said hollow arms (see FIG. 4) (34,35) comprises a heating plate (36) around which is wound the electrical element. The face of each of said arms which is opposite the grid (30) is provided with a longitudinal slot (37) designed to receive a grid for the distribution and protection of the hot air blown through the air blower (20) and as indicated by arrows (24). Said blower (20) starts working automatically upon the closure of the welding frame (11) particularly due to its contact with a switch provided to this effect on the working table (9). Likewise, during said closure operation, the upper arm (35) which is hinged on spindle (10) is brought so as to coincide, by its conduit (33), with the fixed conduit (32) of the fixed lower arm (34). The assembly formed by the two respectively fixed (34) and hinged (35) arms is thus interlocked. Then, by sliding the handle (19) into the slide guide (14) of the frame (11), the entire retraction assembly is moved around the product to be packed (8).

In this way, the entire welding and retraction operations are carried out, not only at the same working station, but completely in full view of the operator, this permitting a complete control over the operations.

The device according to the invention presents many advantages over heretofore solutions, and in particular those listed in the preamble. Among these advantages:

- reduced overall dimensions,
- possibility of being used by unqualified or inexperienced people,
- ready and supple handling,
- the fact that, throughout the entire operation, the products to be packed are in full view of the operator, which enables him to intervene if necessary,
- no discomfort for the operator who no longer receives blasts of hot air into the face;
- possibility of making small packages, and to regroup the retraction of these on the same working table, which increases output rate and reduces cost prices.

The machine according to the invention can therefore be advantageously used for packing various types of goods such as printing works articles: books, magazines, albums, archives, stationery articles, small mechanical parts, and various types of samples: cosmetics, toys, foodstuffs, etc.

What is claimed is:

1. An improved machine for packaging products in thermoretractable film comprising:

- a film working table defining a first plane;
- a roll supplying a film folded in two layers for wrapping said products on said table;
- means for separating the two layers of said film for introducing the product to be packaged between said layers;

means for welding the periphery of said film comprising a welding frame of which two L-forming contiguous sides are equipped with electric heating elements for edge-to-edge welding, said welding frame being tiltable about a longitudinal axis parallel to the said table; and means for retracting the film about the product, said retracting means including a movable crane fastened with said welding frame, and disposed parallel to and above the fixed table, said crane being slidably connected to a longitudinal slide located inside the welding frame, to slide horizontally along the table and sweep the surface of the film to be retracted after the edge-to-edge welding, said crane pivoting inside an orthogonal plane with respect to the plane of the table, and having an operating handle placed at one end of said crane.

2. The improved packaging machine according to claim 1, wherein the movable crane comprises a hollow transverse arm connected with a heat blower means, said arm being open on its face opposite to the table to direct the hot air onto the film to be retracted around the product to be packaged.

3. The improved packaging machine according to claim 2, wherein the table includes a metallic grid, and wherein the movable crane comprises two parallel and hollow transverse arms, placed on either side of the grid table, each arm comprising a conduit connecting it with a blower means, an electric heating element, and a longitudinal slot situated opposite the table and designed to direct hot air onto each face of the film to be retracted and welded around the product to be packaged.

* * * * *